US005082327A

United States Patent [19]

Crisp

[11] Patent Number: 5,082,327

[45] Date of Patent: Jan. 21, 1992

[54] LIFT APPARATUS FOR USE WITH A CHAIR

[76] Inventor: Charles D. Crisp, 80 Colonial Dr., Carrollton, Ga. 30117

[21] Appl. No.: 600,323

[22] Filed: Oct. 19, 1990

[51] Int. Cl.[5] ..... A47C 3/20

[52] U.S. Cl. ..... 297/313; 297/337; 297/DIG. 10

[58] Field of Search ..... 297/313, 333, 337, 339, 297/DIG. 10; 292/302, 156, 162, 175; 16/231, 232

[56] References Cited

U.S. PATENT DOCUMENTS

| | | | |
|---|---|---|---|
| 1,004,975 | 10/1911 | Blackman | 297/313 |
| 2,850,077 | 9/1958 | Dawson | 297/313 |
| 3,158,398 | 11/1964 | Stryker | 297/333 |
| 3,479,087 | 11/1969 | Burker | 297/339 |
| 3,659,897 | 5/1972 | Wright | 297/337 |
| 4,688,851 | 8/1987 | Whiteford | 297/313 |

FOREIGN PATENT DOCUMENTS

| | | | |
|---|---|---|---|
| 2447739 | 10/1975 | Fed. Rep. of Germany | 297/313 |
| 766163 | 1/1957 | United Kingdom | 297/337 |

*Primary Examiner*—Kenneth J. Dorner

*Assistant Examiner*—Cassandra Hope

*Attorney, Agent, or Firm*—Hurt, Richardson, Garner, Todd & Cadenhead

[57] ABSTRACT

A portable lift apparatus for use with chairs, seats and the like comprises a bottom portion that is to be placed atop the seat bottom of the chair and a top portion pivotally mounted to the bottom portion. Support brackets are fixed to the top and bottom portions for mounting the top portion for pivotal movement between a lowered position, a raised position and a neutral position intermediate its raised and lowered positions. Springs are provided for urging the top portion toward its raised position. Latches are provided for releasably securing the top portion in the lowered and neutral positions and comprises means for preventing the top portion from becoming unlatched while in the neutral position. The latches further comprise hook-shaped members attached to the top and bottom portions adapted to partially overlie one another to define a latch opening. A latch pin is movably mounted within the latch opening for movement between an unlocking position and an locking position.

20 Claims, 5 Drawing Sheets

LIFT APPARATUS FOR USE WITH A CHAIR

TECHNICAL FIELD

The present invention relates to devices for assisting physically impaired individuals, and more particularly to an apparatus for helping physically impaired individuals to seat themselves in a chair and to unseat themselves from the chair.

BACKGROUND OF THE INVENTION

Individuals with physical impairments can experience difficulty in seating and unseating themselves in a chair or bench without assistance. This can be the result of a wide variety of temporary or permanent physical impairments, including the loss of a leg or foot, reduced leg strength due to injury, disease or atrophy, reduced flexibility due to arthritis, etc. Such impairments can render one unable to stand up from a chair unassisted and can make it very difficult to sit down safely in the chair.

This problem has been addressed in the art by the development of chairs having a power-driven seat bottom for lifting an individual to help him or her out of the chair, the power being provided by electric, pneumatic or hydraulic means. Chairs or seating assistance devices with power-driven seat bottoms are shown in the following U.S. Pat. Nos.: 3,479,087 to Burke; 3,623,767 to Condon; 4,690,457 to Poncy et al; 4,777,671 to Kearns: and, 4,884,841 to Holley. Such arrangements generally suffer from a need for access to a source of power, making portable use less convenient. These types of devices also tend to be expensive and heavy. Furthermore, these tend to lift the person at a predetermined rate, thereby making it difficult for the person to control the amount of assistance provided during the lifting. In addition, electrifying a chair on which the physically impaired person is sitting, and from which the person might not be able to escape without assistance, introduces a safety hazard to the person. The same is true, to a lesser degree, in the case of hydraulically driven assist devices.

Spring-assisted arrangements have also been provided for helping physically impaired persons in and out of chairs and have the advantage of not requiring electricity or hydraulic actuation, thus removing the safety hazard inherent in these arrangements. Such known spring-assisted arrangements usually include a base frame affixed to or forming part of a frame of the chair, an upholstered seating members pivotally mounted to the base frame and one or more springs for urging the seating member from a lowered position toward a raised, generally tilted position. Arrangements of this type are generally shown in the following U.S. Pat. Nos.: 3,039,818 to Frank; 3,158,398 to Stryker: 4,538,853 and 4,573,736 to Levenberg: and 4,852,849 to Jones. Because the frame of the spring-assisted device usually is specially adapted for attachment to a particular chair or forms an integral part of the chair, known devices of this type have not been well suited to being moved from one chair to another.

Known spring-assisted arrangements typically have a latch mechanism for releasably securing the seating member in the lowered position and for releasing the seating member to allow the springs to provide assistance for unseating and seating. These known latch mechanisms generally suffer from being awkward to operate and they can require that the user operate the latch mechanism during at least part of the user's ascent from the chair. However, it is desirable that the user's hands be free during ascent and descent in order to allow the user to balance himself or herself and to allow the user to hold on to the chair or other nearby items for additional support. As the latching mechanism is to be operated by a person with a physical impairment, it is important that it be easily and reliably operable.

Accordingly, it is seen that a need yet remains for a lift apparatus which can be mounted on a chair, moved from one chair to another and easily operated by the user while leaving the user's hands free during ascent. It is to the provision of such therefore that the present invention is primarily directed.

SUMMARY OF THE INVENTION

Briefly described, the present invention comprises a lift apparatus for use with chairs, seats, benches and the like, the apparatus comprising a bottom portion, a top portion or seating member and support means affixed to the bottom portion and to the top portion for pivotally mounting the top portion to the bottom portion for pivotal movement between a lowered position, a raised, generally tilted position and a neutral position intermediate the lowered and raised positions. The support means comprises a spring means for urging the top portion towards its raised position. Latch means are provided for releasably securing the top portion in its neutral and lowered positions, the latch means comprising a hook-shaped member extending from either the top or bottom portion and a securing member movably mounted to the other of the top and bottom portions The securing member is adapted for movement between a locking position for engaging and securing the hook-shaped member and an unlocking position spaced from the locking position for releasing the hook-shaped member. The latch means further comprises biasing means for urging the securing member toward the locking position, means for releasably securing the securing member in the unlocking position and means responsive to the movement of the top portion toward its raised position for dislodging the securing member from its unlocking position.

With this construction, the user of the apparatus can move the securing member to the unlocking position where it is releasably secured and the user's hands are then free to assist the user as the spring means tend to lift the top portion toward its raised position, thereby assisting the user to rise from the chair or bench. The biasing means tend to ensure that when the user seats himself in the apparatus, the latch means function to secure the top portion in the lowered position.

Preferably, the bottom portion is adapted to be removably placed atop the seat of the chair and the top portion includes cushion means mounted thereto. Cover means are provided for substantially enclosing the bottom portion and the support means to protect the seat of the chair from damage through contact with the bottom portion and with the support means.

The latch means comprises means for preventing the securing member for moving from its locking position toward its unlocking position while the top portion is in its neutral position. With the spring means urging the top portion toward its raised position, the top portion is held in its lowered position only when the weight of the user is on the top portion. With this construction, in the event that some force acts to try to move the securing member to its unlocking position when the user is not seated upon the top portion, as for example if the apparatus were dropped, the apparatus is prevented from opening unexpectedly, thereby protecting the user from potential injury from a rapid opening of the apparatus.

Other features and advantages of the invention will become apparent upon reading the following specification in conjunction with the accompanying drawing figures.

BRIEF DESCRIPTION OF THE DRAWING FIGURES

DETAILED DESCRIPTION

Figure 1:
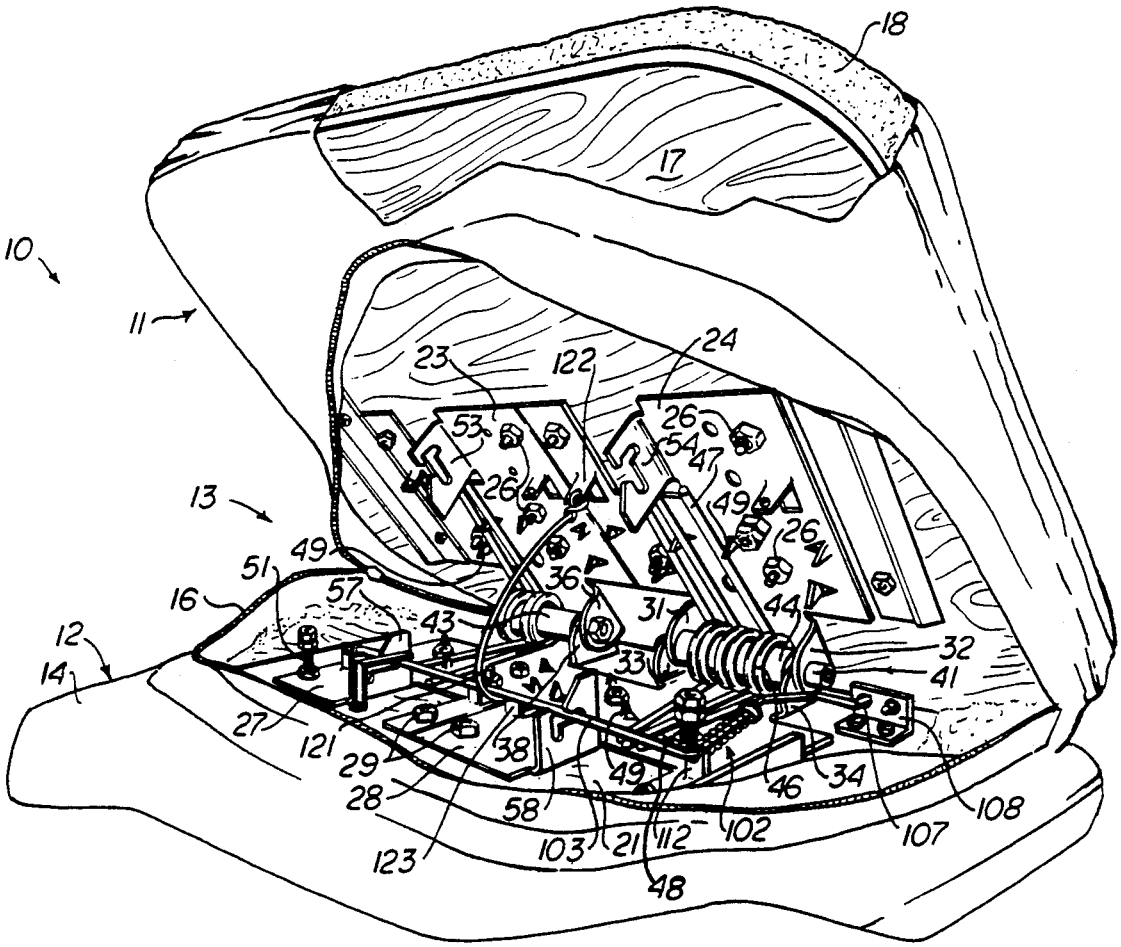
FIG. 1 is a perspective view of a portion of a lift apparatus according to a preferred form of the invention.

Referring now in detail to the drawing figures, in which like reference numerals represent like parts throughout the several views, FIG. 1 shows a lift apparatus 10 for use with chairs, seats, benches and the like in a preferred form of the invention. The lift apparatus 10 includes a top portion 11 and a bottom portion 12. The top portion 11 is pivotally mounted to, and supported above, the bottom portion 12 by support means indicated generally at 13. The support means also includes latch means which will be discussed in more detail below. A cover 14 is sized and adapted to completely envelop the top portion 11 and the bottom portion 12. The cover 14 includes a zipper 16 which allows the cover to be opened so as to slip the cover over the lift apparatus 10 and to provide access to the support means 13. The cover is made of a sturdy cloth, but other materials can be used as may be desired.

Figure 6:
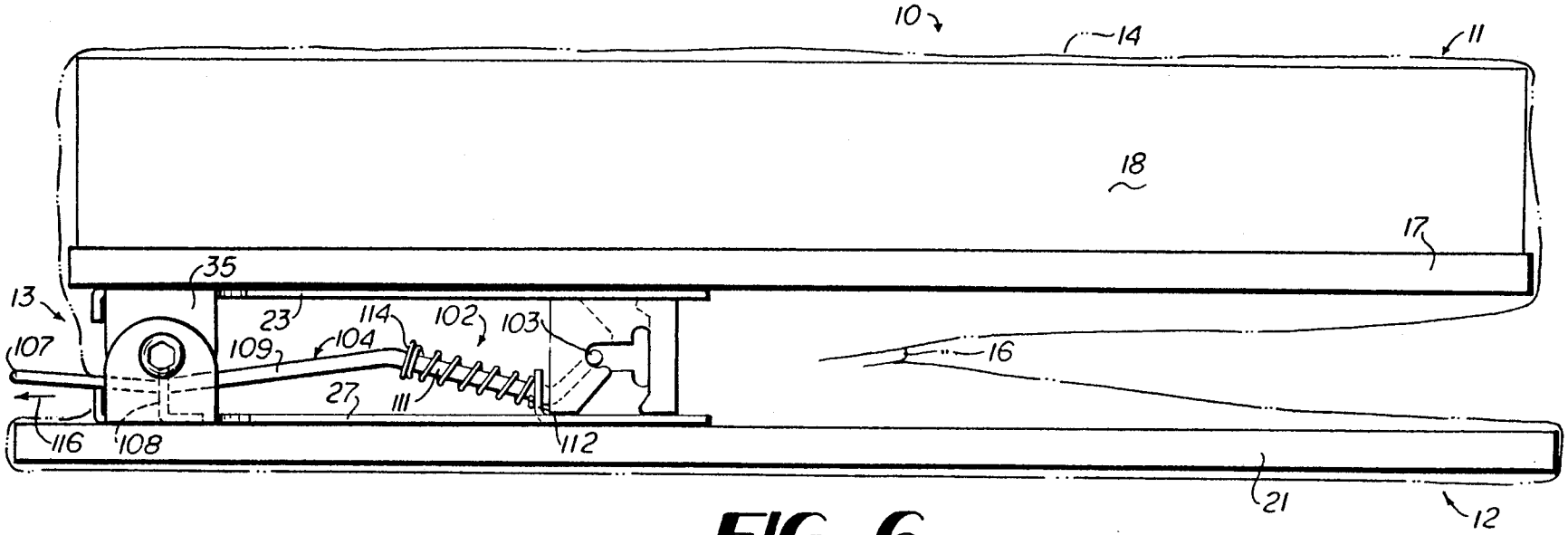
FIGS. 6 and 7 are schematic side views of a lift apparatus in a second form of the invention.

As illustrated in FIGS. 1 and 6, top portion includes a top panel 17 made from a generally rectangular sheet of plywood with rounded corners. Top panel 17 can also be formed of suitable lightweight metal or plastic. A suitably sized cushion 18 is mounted to one side of the top panel 17.

Bottom portion 12 includes a generally rectangular plywood bottom panel 21 with rounded corners and is slightly larger in overall shape than top panel 17.

Figure 3:
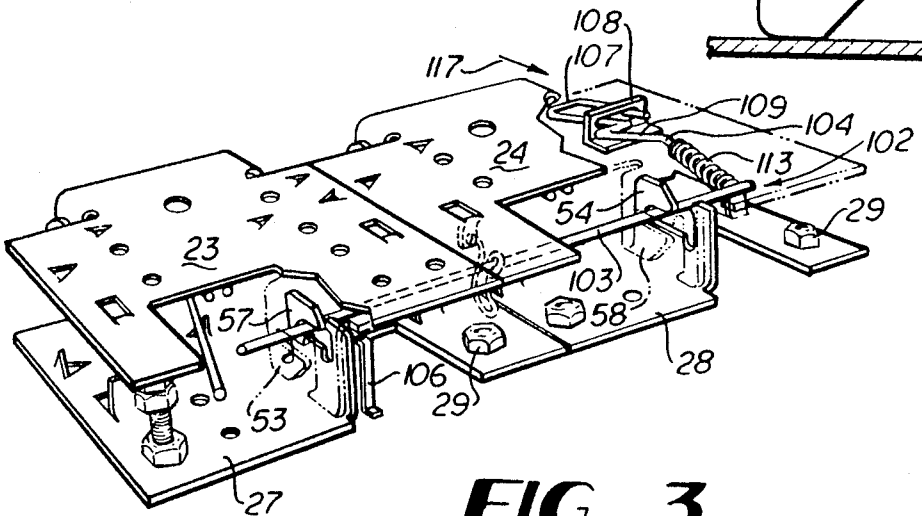
FIG. 3 is a perspective illustration of a portion of the lift apparatus of FIG. 1.

As illustrated n FIGS. 1, 3 and 6, the support means 13 comprises a pair of upper frame member 23 and 24 which are each mounted to an underside portion of the top panel 17 opposite cushion 18 and are secured thereto by a number of threaded fasteners 26. A pair of lower frame members 27 and 28 are mounted to the bottom panel 21 by fasteners 29. All of the upper frame members 23 and 24 and lower frame members 27 and 28 are of identical construction to one another and are each made from a single metal stamping. Each frame member includes hinge tabs which have been formed by a bending operation so as to upstand from the frame member. For example, upper frame member 24 includes hinge tabs 31 and 32 and lower frame member 28 includes identical hinge tabs 33 and 34. The hinge tabs 31, 32, 33 and 34 being identical, it will be noted that hinge tab 31 of upper frame member 24 lies inboard or the hinge tabs 33 and 34 of the lower frame member 28, while the hinge tab 32 lies outboard of hinge tabs 33 and 34. A similar set of hinge tabs 35, 36, 37 and 38 are formed in the upper frame member 23 and lower frame member 27. Each hinge tab includes a hole formed therethrough for receiving a threaded hinge bolt 41 which extends through the hinge tabs to form a hinge. The hinge bolts include unshown shoulders and are secured in the holes formed in the hinge tabs by means of a threaded nut. Sleeves 43 and 44 are positioned about the shoulders of the hinge bolts between the hinge tabs. The sleeves are cylindrical and are able to rotate with respect to the hinge bolts.

A number of torsion springs, such as torsion spring 46, are positioned about the sleeves 43 and 44, with a first end portion 47 of the spring 46 bearing against one of the upper frame members and an opposite end portion 48 of the spring bearing against one of the lower frame members. In this way, the torsion springs tend to spread the upper and lower frame members apart from one another. Small triangular tabs 49 are provided in the upper and lower frame members for holding the end portions of the torsion springs in place. The springs provide the force which tends to open up or raise the top portion 11 with respect to the bottom portion 12. In the specific embodiment disclosed herein, five torsion springs of equal spring rate are provided. The number of springs and their spring rates may be varied to provide an appropriate amount of lift for a given weight range of intended users.

A threaded fastener 51 is mounted to lower frame member 27 and is of a selected length to provide a stop for the adjacent upper frame member so that the downward movement of the upper frame member with respect to the lower frame member is limited to a predetermined minimum height.

Figure 4:
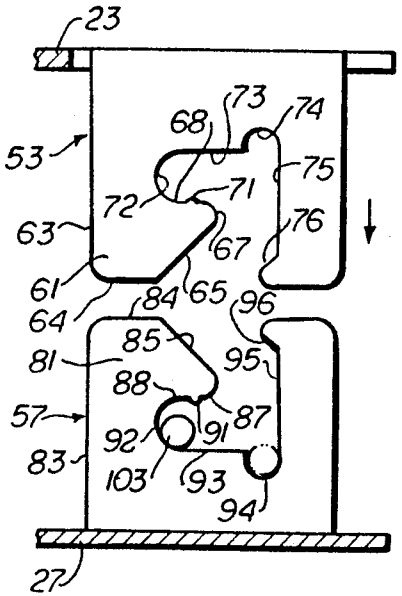
FIG. 4 is schematic side view of a portion of a latching mechanism portion of the lift apparatus of FIG. 1.

Attention is now turned to the latching means 13 referred to earlier. As shown in FIGS. 1 and 3–7, a latch means comprises latch members 53, 54, 57 and 58. Each latch member 53, 54, 57 and 58 is integrally formed with the upper and lower frame member 23, 24, 27 and 28, respectively. As best seen in FIG. 4, the latch members are identical to each other, with the lower latch members extending upwardly from the lower frame members toward the upper frame members and the upper latch members extending downwardly from the upper frame members toward the lower frame members. Further discussion of the latch members will focus on latch members 53 and 57 and it is to be understood that latch members 54 and 58 are identical to these two.

Latch member 53 includes a hook-shaped portion 61 and latch member 57 includes a similar hook-shaped portion 81. Hook-shaped portion 61 includes a front vertical surface 63, a horizontal bottom surface 64 and a cam surface 65 oriented at a 45° angle with respect to horizontal bottom surface 64. Cam surface 65 terminates in a rounded portion 67 which is connected to a first horizontal latch opening surface 68. Horizontal latch opening surface 68 is interrupted by a 0.030" projection 71. Latch opening surface 68 terminates in a U-shaped latch opening surface 72, which in turn is connected with a second horizontal latch opening surface 73. Second horizontal latch opening surface 73 terminates in a second U-shaped latch opening surface or detent 74. The second U-shaped latch opening surface 74 is smaller than the first U-shaped latch opening surface 72 and is perpendicular thereto. Second U-shaped latch opening surface 74 is connected with vertical surface 75 which in turn is connected to second cam surface 76, which is at a 45° angle with respect to vertical surface 75 and is parallel to first cam surface 65.

As shown in FIG. 4, latch member 57 is an inverted duplicate of latch member 53. Therefore, it can be seen that latch member 57 includes the same elements, namely hook-shaped portion 81, front vertical surface 83, horizontal top surface 84, first cam surface 85, rounded portion 87, first horizontal latch opening surface 88, projection 91, U-shaped latch opening surface 92, second horizontal latch opening surface 93, second U-shaped latch opening surface or detent 94, vertical surface 95, and second cam surface 96.

Figure 5B:
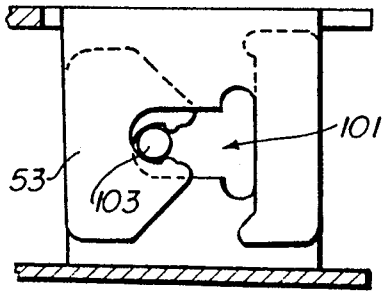
FIGS. 5A and 5B are schematic side views of the latch mechanism of FIG. 4 in latched positions.
Figure 5A:
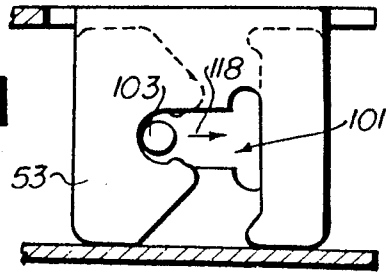

As shown in FIGS. 3, 4, ,5A and 5B, latch members 53 and 54 formed in the upper frame members 23 and 24 are adapted to partially sterile latch members 57 and 58 formed in the lower frame members 27 and 28, respectively. With the upper latch members overlying the lower latch members as shown in FIGS. 5A and 5B, a generally T-shaped latch opening 101 is defined by the various surfaces of the upper and lower latch members. A generally L-shaped securing member 102 comprises a handle portion 104 and a latch pin portion 103. The latch pin portion 103 is a straight length of steel rod which penetrates the latch openings 101 of both pairs of latch members 53 and 57 and 54 and 58. The latch pin portion 103 is slightly smaller in diameter than the size of the second U-shaped latch opening surface or detent 94 so that +he latch pin portion can be received therein. The latch pin portion 103 is significantly smaller in diameter than the size of the first U-shaped latch opening surface 92. An L-shaped guide member 106 is mounted to bottom pa-el 21 adjacent latch member 57 for retaining an end of latch pin portion 103 within the latch opening 101.

Handle portion 104 of the securing member 102 includes a generally U-shaped external handle 107 protruding through the front portion of the lift apparatus 10. The U-shaped handle 107 extends through an L-shaped bracket 108 which is mounted to the bottom panel 21 by suitable fasteners. The legs of the U-shaped handle extend through suitably sized holes formed in the L-shaped bracket 108. In this way, the L-shaped bracket acts as a guide for the U-shaped handle 107. The U-shaped handle portion 107 is substantially parallel to bottom panel 21. An intermediate portion 109 is bent upwardly from the U-shaped handle 107 and a second intermediate portion 111 is bent downwardly from the first intermediate portion 109 and extends through a hole formed in an upstanding bracket 112. The biasing spring 113 is mounted about the second intermediate portion 111 and bears against flange 114 for urging the handle portion 104 in the direction of arrow 116.

A flexible cable 121 is mounted at one of its ends to a tab 122 formed in upper frame member 24 and is mounted at an opposite end to a tab 123 formed in lower frame member 128. The tabs 122 and 123 are positioned between the hinge bolts 41 and the latch members 53, 54, 57 and 58. Furthermore, the flexible cable 121 is looped about the latch pin portion 103.

Figure 8:
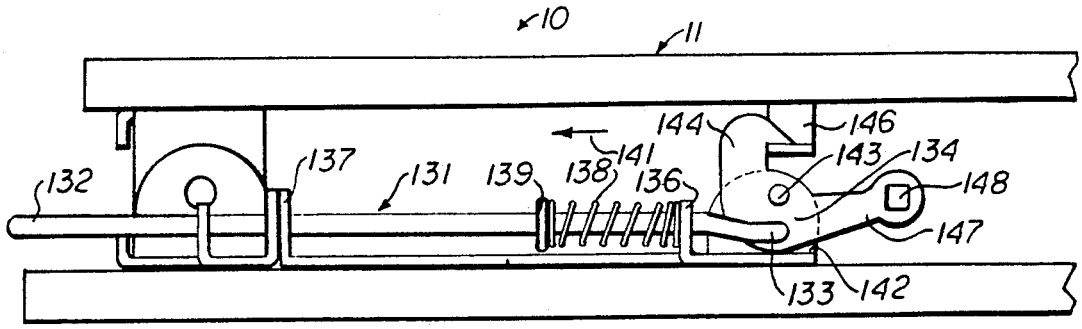
FIG. 8 is a schematic side view of a lift apparatus according to a third form of the invention.
Figure 9:
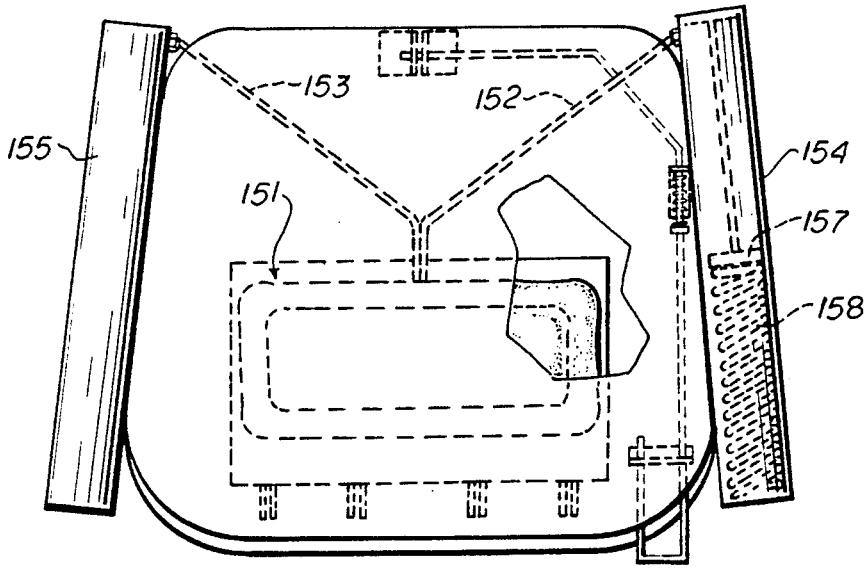
FIG. 9 is a schematic top view of a lift apparatus according to a fourth form of the invention.
Figure 10:
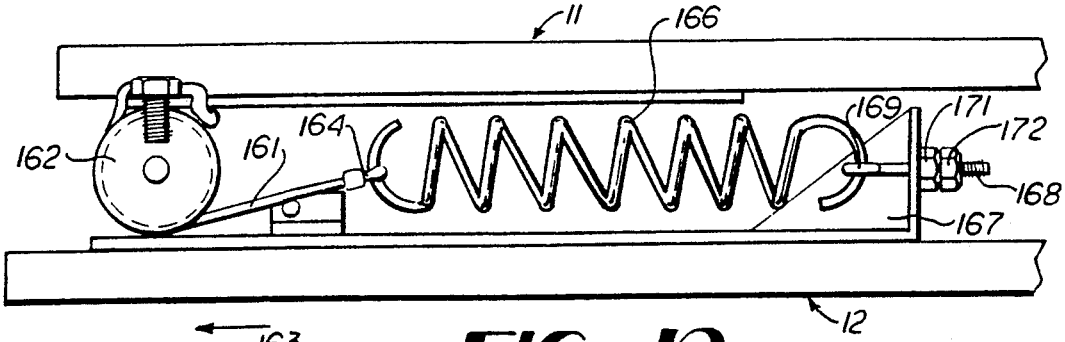
FIG. 10 is a schematic side view of a lift apparatus according to a fifth form of the invention.
Figure 11:
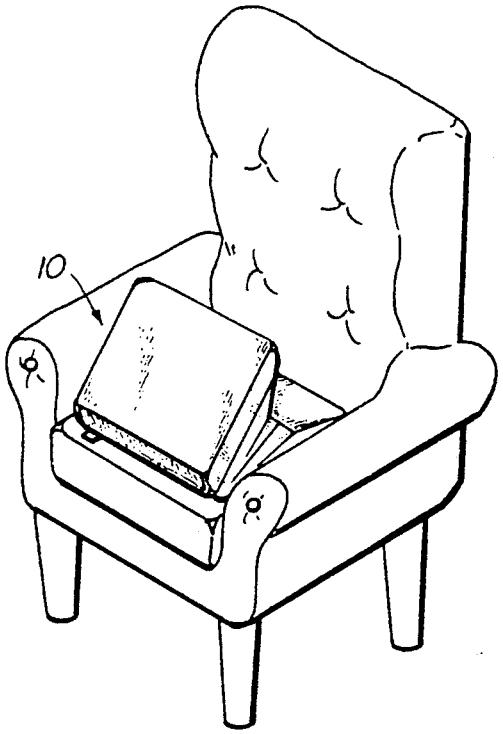
FIG. 11 is a perspective illustration of the lift apparatus of FIG. 1 shown mounted on a chair.

FIGS. 8–10 show some possible modifications to the present invention. For example, in FIG. 8 the latch assembly is significantly modified from the preferred embodiment. In FIG. 8, an elongated actuating rod 131 is relatively straight and includes an external handle portion 132 and an opposite end 133 mounted to latch member 134. The actuating rod 131 extends through an L-shaped bracket 136 and through a second bracket 137. A biasing spring 138 is mounted about the actuating rod 131 and bears against L-shaped bracket 136 and against a flange 139 mounted to the actuating rod for urging the actuating rod in the direction of direction arrow 141. Latch member 134 is pivotally mounted to an upstanding latch tab 142 for pivotal movement about a pivot pin 143. A hook-shaped portion 144 of the latch member 134 extends upwardly toward the top portion 11 for engagement with an L-shaped finger 146 extending downwardly from top portion 11. A rearwardly extending arm 147 is formed on the latch member 134 for driving a square-ended shaft 148 to communicate motion of the latch member 134 to a second (unshown) latch member of identical construction.

In FIG. 9, a hydraulic bladder indicated generally at 151 is used to generate hydraulic pressure as the top portion is moved from the raised position to the lowered position and the hydraulic pressure generated thereby is communicated by means of conduits 152 and 153 to hydraulic cylinders 154 and 155. Each hydraulic cylinder includes a piston 157 with which the hydraulic pressure can compress a compression spring 158. In this arrangement, the energy is stored in and recovered from the compression spring with the hydraulic pressure being used to replace mechanical elements.

FIG. 10 shows the use of a tension spring, as compared with the use of a torsion spring as depicted in FIG. 1. Using a tension spring has the advantage of allowing a simple mechanism to be provided for adjusting the force applied by the spring to the top portion 11. Alternatively, a compression spring can be used in place of a tension spring. In FIG. 10, a steel cable 161 is mounted to the top portion 11 and is wound about a pulley 162. As the top portion 11 is moved from the raised position to the lowered position or neutral position, the cable 161 is drawn in the direction of direction arrow 163. The steel cable 161 is connected at one of its ends 164 to an end of a tension spring 166. An opposite end of the tension spring 166 is secured to an upstanding bracket 167 mounted to the lower portion 12 by means of a threaded fastener 168 having a hook or eyelet 169 for receiving the tension spring 166. Alternatively, the cable and pulley arrangement can be replaced with a gear mechanism, for example a pinion gear fixed to the top portion and a rack gear slidably mounted to the bottom portion with the rack gear attached to a spring. A pair of threaded nuts 171 and 172 are provided for adjusting the longitudinal position of the threaded fastener 168 with respect to bracket 167. In this way, the force applied by the spring 166 can be quickly and easily adjusted.

OPERATION

In use, the lift apparatus may be carried by a user and placed upon a chair to assist the user in seating himself in the chair or unseating himself from the chair. This portability is aided greatly by the fact that the entire apparatus weights but a mere nine pounds and that it is self contained and enclosed by the cloth cover to protect the chair or other seating device upon which the apparatus is placed.

Figure 2A:
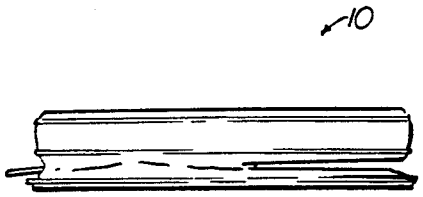
FIGS. 2A and 2B are side elevation views of the lift apparatus of FIG. 1, showing the lift apparatus in lowered and raised positions respectively.
Figure 2B:
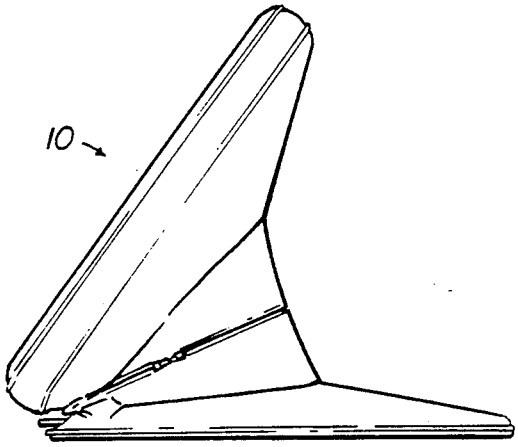

To seat one's self in a chair using the lift apparatus placed on a chair with the lift apparatus opened to the raised position, one merely proceeds as if to sit down normally and as the lower portion of the user's body contacts the top portion of the lift apparatus, the force provided by the torsion springs tends to help ease the user down into the chair by providing a resisting force. As the top portion moves from the raised position of FIG. 2B towards the lower or neutral position, the latch members formed of the upper frame members move towards an overlying position with respect to the latch members formed of the lower frame members. (See FIG. 4). As this occurs, the cam surface 65 of latch member 53 contacts the latch pin portion 103 of the securing member and urges it from the locking position shown in solid lines in FIG. 4 toward the unlocking position shown in dashed lines in FIG. 4. However, the cam surface 65 is not long enough to cause the latch pin portion 103 to fully reach the unlocking position, but merely moves it out of the way far enough for the hook-shaped portion 61 of the latch member 53 to pass by the latch pin portion 103. Thus, the latch member 53 moves from the slightly raised position shown in FIG. 4 toward the neutral position in FIG. 5B. The weight of the person's body carries the top portion 11 and the latch member 53 through the neutral position of FIG. 5B toward the fully lowered position of FIG. 5A.

In the neutral position depicted in FIG. 5B, it will be observed that the surfaces of the latching members 53 and 57 that define the latch opening do not completely coincide but rather that there is some overlap. It will be noted that the projections 71 and 91 extend partially across the latch opening in this neutral position, thereby constricting the latch opening and preventing the latch pin portion 103 from moving from its locking position shown in solid lines in FIG. 4 to the unlocking position shown in dashed lines. Normally, the person's weight resting on top of the top portion 11 causes the top portion 11 to move to the fully lowered position shown in FIG. 5A in which the surfaces of latch member 53 and latch member 57 coincide substantially so as to define a latch opening which is large enough to pass the latch pin portion 103 from its locking position (the left-most position as depicted in the figures) to its unlocking position (the lower-most right hand position as depicted in the figures). With this construction, in the event that one should accidentally manipulate the handle or drop the apparatus on its handle, the lift apparatus is prevented from unexpectedly and rapidly opening, thereby protecting the user or bystander from injury. This is so because without the weight of a person pressing on the top portion and causing it to assume the fully lowered portion of FIG. 5A, the projections 91 and 71 act to retain the latch pin portion 103 in the locking position despite attempts or forces tending to unlock the latch mechanism.

With the user now seated upon the cushioned top portion 11, the user can operate the latch mechanism to release the top portion and allow it to be moved by the springs to the raised position. The user pushes inwardly on the U-shaped handle 107 in the direction of direction arrow 117. This causes the latch pin portion to move in the direction of direction arrow 118. As the latch pin portion 103 moves to the right in the direction of direction arrow 118, the bent intermediate portion 111 of the handle acts as a cam as it moves through the aperture in the bracket 112 to cause the latch pin portion 103 to tend to move downwardly. Thus, as the latch pin portion approaches the vertical surfaces 75, it is drawn downwardly into the detent 94. In this way, the latch pin portion is releasably secured in its unlocking position, allowing the user to ascend from the chair while keeping both hands free. This is accomplished because the user can depress the handle and unlock the latch and then release the handle and the handle remains locked in the unlocking position.

The user now ascends from the chair with both hands free to support him by grabbing other objects. As the user attempts to ascend, the torsion springs tend to help lift him out of the chair. Control of the amount of assistance provided by the torsion springs to the user is easily controlled by leaning forward or backward in the chair so as to vary the amount of torque being applied to the springs by the person's weight applied to the top portion 11 of the lift apparatus. This is the result of the fact that the torque placed on the springs by the person's weight is proportional to the distance from the pivot point at which the weight is applied.

Figure 7:
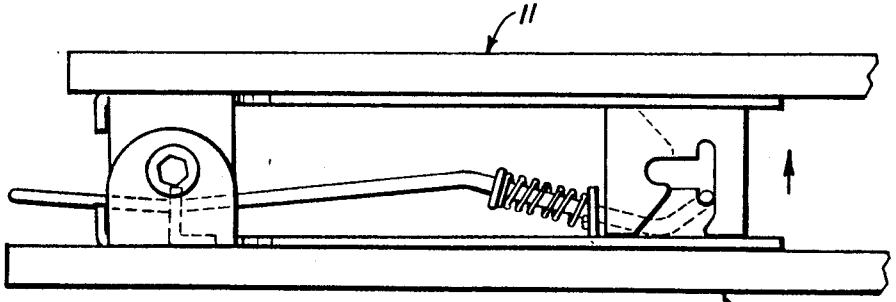

As the top portion 11 is moved from the position of FIG. 7 toward the position of FIG. 4, cam surface 76 bears against the latch pin portion 103 and urges the latch pin portion to exit the detent 94. With the latch pin portion 103 now dislodged from the detent, the biasing spring 113 quickly returns the latch pin portion 93 to its locking position (the left-most position in the figures). In the event that the user or someone else should accidentally or intentionally depress the handle 107 in an attempt to release the latch mechanism after this point, the flexible member 121 acts as a safety mechanism to pop or pull the latch pin portion 103 out of the detent and to allow it to be moved by the biasing spring 11 back to the locking position. This is accomplished by the flexible member being of a selected length so that as the top portion moves to the raised position, if the latch pin portion 103 is in the unlocking position in the detent, the flexible member becomes taut and pulls the latch pin portion from the detent.

While the invention has been disclosed in preferred forms only, it is to be understood that many modifications, deletions and additions may be made therein by those skilled in the art without departing from the spirit and scope of the invention as set forth in the following claims.

I claim:

1. A lift apparatus for use with chairs, seats, benches and the like having a seating portion comprising:

a bottom portion, a top portion mounted to said bottom portion for pivotal movement between a lowered position, a raised position and a neutral position intermediate said raised and lowered positions, spring means for urging said top portion toward said raised position, and latch means for releasably securing said top portion in said lowered and neutral positions comprising:

a first latching member extending from one of said top and bottom portions, a securing member movably mounted to the other of said top and bottom portions for movement between a locking position for engaging and securing said latching member and an unlocking position spaced from said locking position for releasing said latching member, bias means for urging said securing member toward said locking position, cam means for urging said securing member toward said unlocking position as said top portion is moved from said raised position toward said lowered position, means for preventing said securing member from moving from said locking position to said unlocking position while said top portion is in said neutral position, and means for releasably securing said securing member in said unlocking position and means responsive to the movement of said top portion toward said raised position for dislodging said securing member from said unlocking position.

2. A lift apparatus as claimed in claim further comprising a second latch member extending from said other of said top and bottom portions and adapted to cooperate with said first latch member to define a latch opening with said top portion in said lowered and neutral positions, and wherein said means for preventing said securing member from moving from said locking position to said unlocking position comprises means for constricting said latch opening.

3. A lift apparatus as claimed in claim 1 wherein said first latch member comprises a hook-shaped member extending from said top portion and wherein said securing member is movably mounted to said bottom portion, the apparatus further comprising a second hook-shaped member extending from said bottom portion and adapted to partially overlie said hook-shaped member extending from said top portion to define a latch opening between said hook-shaped members with said top portion in said lowered and neutral positions, said securing member comprising an elongated pin and wherein said locking and unlocking positions are located within said latch opening.

4. A lift apparatus as claimed in claim 1 wherein said means for dislodging said securing member comprises cam means mounted to said one of said top and bottom portions for engaging said securing member as said top portion moves from said lowered position toward a slightly raised position intermediate said lowered and raised positions.

5. A lift apparatus as claimed in claim 1 wherein said means for dislodging said securing member comprises elongated flexible member means having ends mounted to each of said top and bottom portions and at least partly looped about said securing member for urging said securing member toward said locking position as said top portion is moved toward said raised position.

6. A lift apparatus for use with chairs, seats, benches and the like having a seating portion comprising:

a bottom portion, a top portion, support means affixed to said bottom portion and to said top portion for mounting said top portion to said bottom portion for pivotal movement between a lowered position, a raised position and a neutral position intermediate said raised and lowered positions, said support means including spring means for urging said top portion toward said raised position, and latch means for releasably securing said top portion in said lowered and neutral positions comprising a hook-shaped member extending from one of said top and bottom portions and a securing member movably mounted to the other of said top and bottom portions for movement between a locking position for engaging and securing said hook-shaped member and an unlocking position spaced from said locking position for releasing said hook-shaped member, said latch means further comprising bias means for urging said securing member toward said locking position, means for releasably securing said securing member in said unlocking position and means responsive to the movement of said top portion toward said raised position for dislodging said securing member from said unlocking position.

7. A lift apparatus as claimed in claim 6 wherein said latch means comprises means for preventing said securing member from moving from said locking position to said unlocking position while said top portion is in said neutral position.

8. A lift apparatus as claimed in claim 7 further comprising a member extending from said other of said top and bottom portions and adapted to cooperate with said hook-shaped member to define a latch opening with said top portion in said lowered and neutral positions, and wherein said means for preventing said securing member from moving from said locking position to said unlocking position comprises means for constricting said latch opening.

9. A lift apparatus as claimed in claim 8 wherein said means for constricting said latch opening comprises a first projection formed on said hook-shaped member and a second projection formed on said member extending from said other of said top and bottom portions, wherein said first and second projections are positioned intermediate said locking position and said unlocking position.

10. A lift apparatus as claimed in claim 6 wherein said hook-shaped member extends from said top portion and wherein said securing member is movably mounted to said bottom portion, the apparatus further comprising a second hook-shaped member extending from said bottom portion and adapted to partially overlie said hook-shaped member extending from said top portion to define a latch opening between said hook-shaped members with said top portion in said lowered and neutral positions, said securing member comprising an elongated pin and wherein said locking and unlocking positions are located within said latch opening.

11. A lift apparatus as claimed in claim 6 wherein said hook-shaped member comprises cam means for urging said securing member toward said unlocking position as said top portion is moved from said raised position toward said lowered position.

12. A lift apparatus as claimed in claim 6 wherein said latch means further comprises a latch member mounted to said other of said top and bottom portions, said latch member at least partly defining a latch opening within which said securing member is movably mounted, said means for releasably securing said securing member comprising a detent portion of said latch opening for receiving said securing member.

13. A lift apparatus as claimed in claim 6 wherein said means for dislodging said securing member comprises cam means mounted to said one of said top and bottom portions for engaging said securing member as said top portion moves from said lowered position toward a slightly raised position intermediate said lowered and raised positions.

14. A lift apparatus as claimed in claim 6 wherein said means for dislodging said securing member comprises elongated flexible member means having ends mounted to each of said top and bottom portions and at least partly looped about said securing member for urging said securing member toward said locking position as said top portion is moved toward said raised position.

15. A lift apparatus as claimed in claim 6 wherein said bottom portion is adapted to be removably placed atop a seat bottom of the chair and wherein a cushion means is mounted to said top portion, the apparatus further comprising cover means substantially enclosing said bottom portion and said support means for protecting the seating portion of the chair from damage from contact with said bottom portion and said support means.

16. A lift apparatus as claimed in claim 15 wherein said bottom portion comprises a bottom panel and wherein said top portion comprises a top panel, said support means further comprising a first frame member mounted to said bottom panel, a second frame member mounted to said top panel, and hinge means pivotally connecting said second frame member to said first frame member.

17. A lift apparatus as claimed in claim 16 further comprising a third frame member mounted to said bottom panel, a fourth frame member mounted to said top panel and second hinge means pivotally connecting said third and fourth frame members to each other, and wherein first, second, third and fourth frame members are all of substantially identical construction.

18. A portable lift apparatus for use with chairs, seats, benches and the like devices having a seat bottom, comprising:

a bottom portion including a bottom panel and adapted to be removably placed atop the seat bottom of the chair, a top portion including a top panel and cushion means mounted to said top panel for supporting a person seated thereon, support means affixed to said bottom panel and to said top panel for mounting said top portion to said bottom portion for pivotal movement between a lowered position, a raised position an a neutral position intermediate said raised and lowered positions, said support means comprising a first frame member mounted to said bottom panel, a second frame member mounted to said top panel, hinge means pivotally connecting said second frame member to said first frame member, and spring means for urging said top portion toward said raised position, said support means further comprising latch means for releasably securing said top in said lowered and neutral positions, said latch means comprising means for latching said top portion in said lowered and neutral positions and means for preventing said top portion from becoming unlatched while in said neutral position, and cover means substantially enclosing said bottom portion and said support means for protecting the seat bottom of the chair from damage from contact with said bottom portion and said support means.

19. A lift apparatus as claimed in claim 18 wherein said latch means comprises a first generally hook-shaped member extending from said top panel toward said bottom panel, a second generally hook-shaped member extending from said bottom panel toward said top panel, said first and second hook-shaped members being adapted to partially overlie one another to define a latch opening between said hook-shaped members with said top portion in said lowered position, said latch means further comprising an elongated latch pin mounted for movement between a locked position in said latch opening and an unlocked position spaced from said locked position in said latch opening.

20. A lift apparatus as claimed in claim 18 further comprising a third frame member mounted to said bottom panel, a fourth frame member mounted to said top panel and hinge means pivotally connecting said third and fourth frame members to each other, and wherein said first, second, third and fourth frame members are all of substantially identical construction.

* * * * *